US005961010A

United States Patent [19]

Smith

[11] Patent Number: 5,961,010

[45] Date of Patent: Oct. 5, 1999

[54] DISPENSING BEVERAGE CLOSURE

[75] Inventor: Robert J. Smith, Edinboro, Pa.

[73] Assignee: Erie Country Plastics Corporation, Corry, Pa.

[21] Appl. No.: 09/005,063

[22] Filed: Jan. 9, 1998

Related U.S. Application Data

[60] Provisional application No. 60/035,176, Jan. 9, 1997.

[51] Int. Cl.[6] ..... B67D 3/00

[52] U.S. Cl. ..... 222/534; 222/533; 222/527

[58] Field of Search ..... 222/534, 533, 222/527

[56] References Cited

U.S. PATENT DOCUMENTS

| | | | |
|---|---|---|---|
| 3,318,494 | 5/1967 | Porter et al. | 222/534 |
| 3,851,805 | 12/1974 | Hazard | 222/534 |
| 4,081,113 | 3/1978 | Hazard | 222/534 |
| 4,903,870 | 2/1990 | La Vange | 222/534 |
| 5,065,881 | 11/1991 | Tarng | 222/534 |
| 5,671,868 | 9/1997 | Herr | 222/1 |

*Primary Examiner*—Andres Kashnikow
*Assistant Examiner*—Keats Quinality
*Attorney, Agent, or Firm*—Webb Ziesenheim Logsdon Orkin & Hanson, P.C.

[57] ABSTRACT

An injection moldable closure includes a base member having a top and a substantially cylindrical side with internal threads thereon. The top of the base member includes a socket with an aperture at the bottom of the socket and a groove extending away from the socket. The closure includes a pour spout which is symmetrical about a longitudinal axis thereof. The pour spout includes a cylindrical stem, a ball attached at one end of the cylindrical stem and a passageway extending through the cylindrical stem and the ball along the longitudinal axis of the pour spout. The ball of the pour spout is received within the socket such that the pour spout can be moved between a closed position with the cylindrical stem received within the groove and an open position wherein the passageway is aligned with the aperture.

8 Claims, 2 Drawing Sheets

DISPENSING BEVERAGE CLOSURE

This application claims the benefit of Provisional Patent Application No. 60/035,176 entitled "Dispensing Beverage Closure" filed on Jan. 9, 1997.

BACKGROUND OF THE INVENTION

1. Field of the Invention

The present invention relates to beverage closures, more specifically, the present invention relates to injection moldable beverage closures.

2. Background of the Invention

Beverage containers are of ever-increasing economic importance. In designing new beverage closures, various performance characteristics must be taken into consideration including ease of use, ability to pour, venting characteristics, moldability, as well as the ease of opening, closing and resealing. In addition to these performance characteristics, creating a closure which can easily provide evidence of tampering is also important. All of these performance characteristics must be adequately considered while maintaining a closure which can be easily produced and manufactured at minimum costs. It is an object of the present invention to effectively balance all of these considerations to provide an injection moldable dispensing beverage closure.

SUMMARY OF THE INVENTION

The objects of the present invention are achieved by providing an injection moldable plastic closure comprising a base member having a top and a substantially cylindrical side with internal threads thereon. The internal threads of the cylindrical sides are adapted to attach the closure to a beverage container. The top of the base member includes a socket with an aperture at the base of the socket which extends through the top, and a groove extending away from the socket. The closure additionally includes a pour spout which is symmetrical about a longitudinal axis thereof. The pour spout includes a cylindrical stem, a ball attached at one end of the cylindrical stem and a passageway extending through the cylindrical stem and the ball along the longitudinal axis of the pour spout. The closure is provided such that the ball of the pour spout is received within the socket of the top to be moved between a retracted, closed position and an open position. In the open position, the passageway is aligned with the aperture of the socket and in the closed position, the cylindrical stem of the pour spout is received within the groove of the top. With the spout in the closed position, the contents of the beverage container are prevented from escaping. Additionally, the spout is held in the closed position by the lip of the groove, whereby the spout is prevented from moving to the open position.

These and other objects of the present invention will be clarified in the description of the preferred embodiment taken in connection with the attached figures wherein like reference numerals represent like characters throughout.

BRIEF DESCRIPTION OF THE PREFERRED EMBODIMENT

Figure 1:
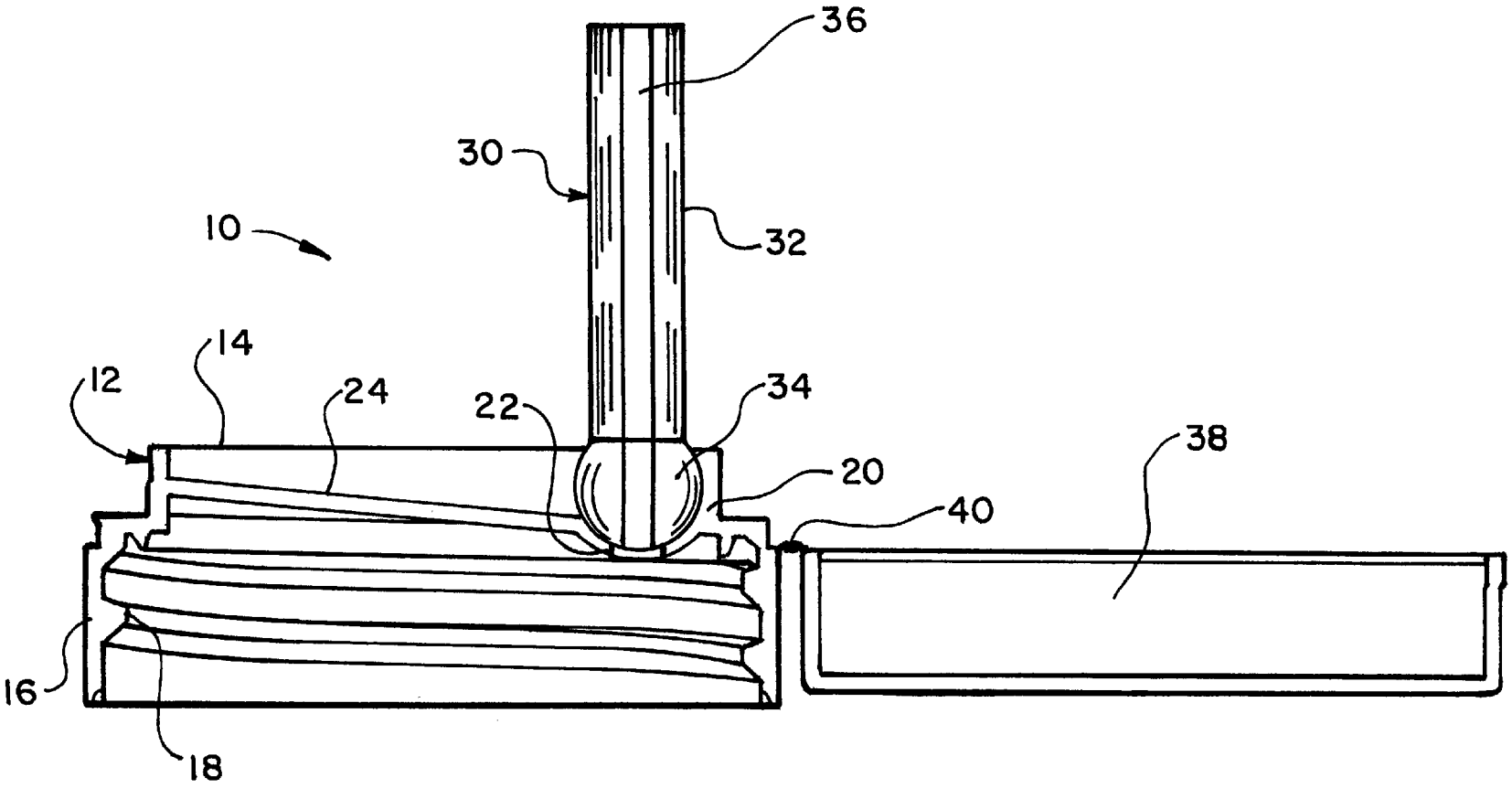
FIG. 1 is a sectional view of an injection moldable closure according to the present invention.

FIG. 1 illustrates an injection moldable closure 10 according to a first embodiment of the present invention. The closure 10 includes a base member 12 having a top 14 and a substantially cylindrical side 16. The side 16 includes internal threads 18 thereon which are adapted to couple the closure 10 to a beverage container at an externally threaded opening thereof. The top 14 includes a substantially round socket 20 with an aperture 22 positioned at the bottom of socket 20 extending through the base member 12. The aperture 22 is adapted to be in communication with the opening at the top of a beverage container. The top 14 additionally includes a groove 24 extending radially away from the socket 20. Groove 24 has a width slightly smaller than a diameter of spout 30, whereby spout 30 is engaged and held when in the closed position by the pliant flanges of groove 24.

A pour spout 30 is provided which includes a cylindrical stem 32 and ball 34 attached at one end of the cylindrical stem 32. The stem 32 and ball 34 are positioned along the longitudinal axis of the pour spout 30 such that the pour spout 30 is symmetrical about its longitudinal axis. The pour spout 30 includes a passageway 36 extending through the cylindrical stem 32 and ball 34 along the longitudinal axis of the pour spout 30.

Figure 2:
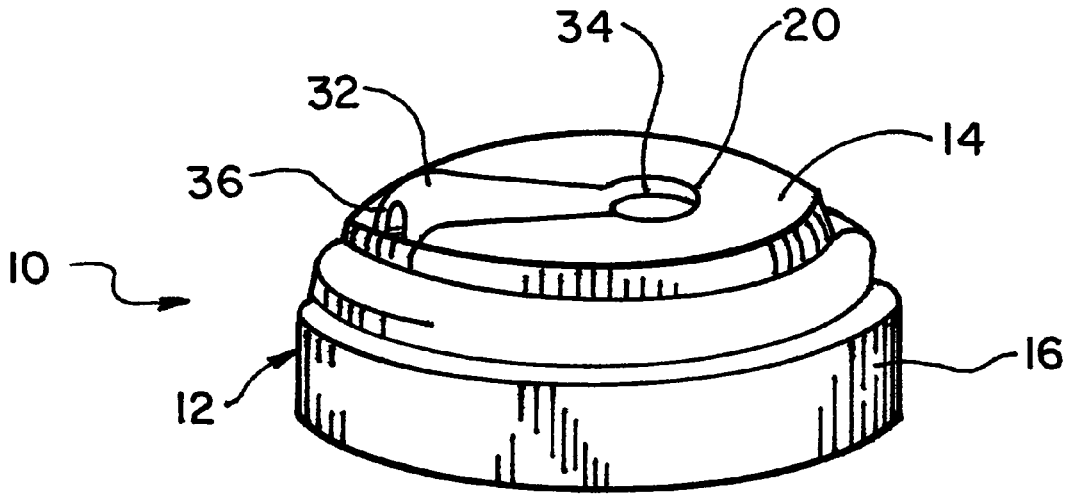
FIG. 2 is a perspective view of the closure illustrated in FIG. 1 without the cap thereof and with the closure shown in the closed position.
Figure 3:
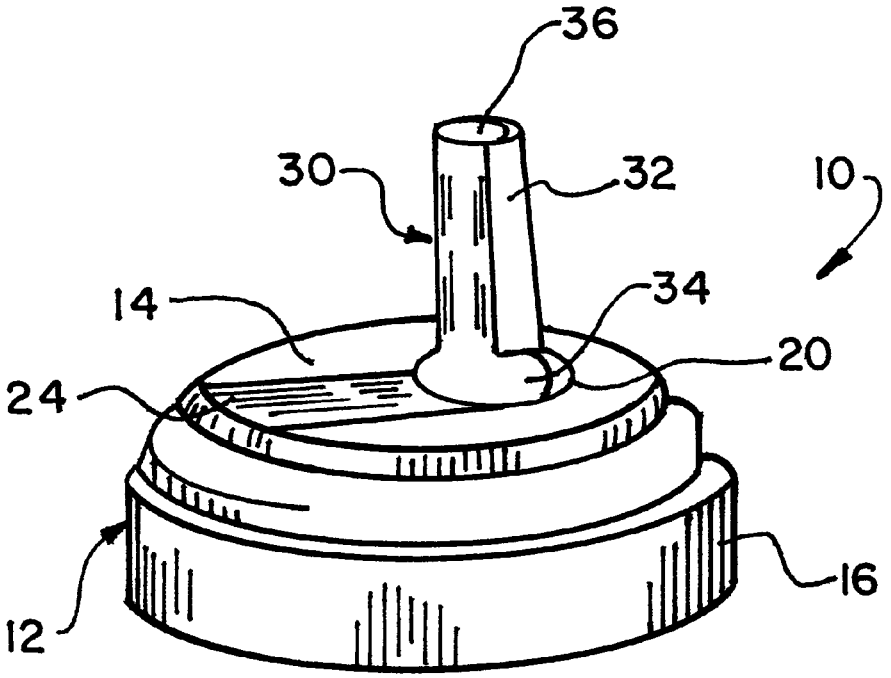
FIG. 3 is a perspective view of the closure illustrated in FIG. 1 without the cap thereof and with the closure illustrated in the open position.

The ball 34 of the pour spout 30 is received within the socket 20 of the top 14 as illustrated in the figures. The pour spout 30 is adapted to move between a closed position illustrated in FIG. 2 and an open position illustrated in FIG. 3. In the open position, the passageway 36 is aligned with and in fluid communication with the aperture 22 allowing access to the opening of the beverage container. With the pour spout 30 in the closed position, the cylindrical stem 32 is received within the groove 24 of the top 14. In the closed position, the passageway 36 will no longer be aligned with the aperture 22 thereby having the remaining portions of the ball 34 seal the aperture 22.

The present invention may additionally include a cap member 38 attached to the top 14 by hinge 40. The cap member 38 is adapted to close over top of the top 14 with the pour spout 30 in the closed position. The base member 12 of the present invention preferably uses thermo-plastic material of a thickness between 0.045 to 0.060 inches, preferably about 0.035 inches which will provide sufficiently sturdy products meeting all of the design and performance criteria.

The closure 10 of the present invention provides several distinct advantages over prior art closures. Specifically, the closure 10 of the present invention is designed so that all of the parts can be easily injection moldable. The closure 10 is injection molded as two pieces comprising the base member 12, which may or may not include the associated cap member 38 and pour spout 30. The closure 10 of the present invention provides a manufacturing advantage by constructing the symmetrical pour spout 30. With a symmetrical pour spout 30, the manufacturing step of assembling the separately injection moldable pieces becomes easier and very simple to automate. With a cylindrically symmetrical pour spout 30, there is no requirement to ascertain the specific orientation of the pour spout 30 by an assembly apparatus when spout 30 is inserted into socket 20. Without orientation requirements, the process becomes much easier to automate, only requiring that the ball 34 of the pour spout 30 be inserted into the socket 20 without first orienting the respective pieces axially.

Additionally, the closure 10 of the present design provides a compact, clean arrangement for the pour spout 30 of the present invention.

It will be obvious to those of ordinary skill in the art that various modifications may be made to the present invention without departing from the spirit and scope thereof. Consequently, the scope of the present invention is intended to be defined by the following claims.

I claim:

1. A moldable closure comprising:

a) a base member having a top and a side extending down from the top, said top including a socket with an aperture at the bottom of said socket; and b) a pour spout symmetrical about a longitudinal axis thereof, said pour spout including a cylindrical stem, a ball attached at one end of said cylindrical stem, and a passageway extending through said cylindrical stem and said ball along said longitudinal axis, said ball of said pour spout received within said socket of said top, wherein said pour spout is adapted to be moved between a retracted, closed position and an open position with said passageway aligned with said aperture.

2. The closure of claim 1 further including a groove in said top, wherein said stem in said closed position is received in said groove.

3. The closure of claim 2 wherein said groove includes pliant flanges adapted to maintain said stem in said closed position.

4. The closure of claim 1 wherein said side is cylindrical, said side further including internal threads thereon.

5. The closure of claim 1 further including a cap member attached to said top by a hinge.

6. The closure of claim 1 wherein said closure is injection molded using thermo-plastic material forming said base member of a thickness between 0.45 to 0.60 inches.

7. An injection moldable pour spout for pivotable attachment to a top of a base member, said pour spout symmetrical about a longitudinal axis thereof and said pour spout comprising:

a cylindrical stem;

a ball attached at one end of said cylindrical stem; and a passageway extending through said cylindrical stem and said ball along said longitudinal axis.

8. An injection moldable closure comprising:

a) a base member having a top and a substantially cylindrical side, said side having internal threads thereon, said top including a socket with an aperture at a bottom of said socket and said top having a groove extending away from said socket; and b) a pour spout symmetrical about a longitudinal axis thereof, said pour spout including a cylindrical stem, a ball attached at one end of said cylindrical stem, and a passageway extending through said cylindrical stem and said ball along said longitudinal axis;

wherein said ball of said pour spout is received within said socket of said top whereby said pour spout is adapted to be moved between a retracted, closed position with said cylindrical stem received in said groove, and an open position with said passageway aligned with said aperture.

* * * * *